US011181068B1

(12) United States Patent
Kato et al.

(10) Patent No.: US 11,181,068 B1
(45) Date of Patent: Nov. 23, 2021

(54) INJECTION CONTROL DEVICE

(71) Applicant: DENSO CORPORATION, Kariya (JP)

(72) Inventors: Kosuke Kato, Kariya (JP); Yasumasa Ishikawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/333,126

(22) Filed: May 28, 2021

(30) Foreign Application Priority Data

Jun. 29, 2020 (JP) ..... JP2020-111597

(51) Int. Cl.

| | |
|---|---|
| ***F02D 41/14*** | (2006.01) |
| ***F02D 41/20*** | (2006.01) |
| ***F02D 41/22*** | (2006.01) |
| ***F02D 41/38*** | (2006.01) |

(52) U.S. Cl.
CPC ..... *F02D 41/38* (2013.01); *F02D 41/1454* (2013.01); *F02D 41/20* (2013.01); *F02D 41/221* (2013.01); *F02D 2041/2034* (2013.01); *F02D 2041/2058* (2013.01); *F02D 2041/224* (2013.01)

(58) Field of Classification Search
CPC .... F02D 41/1454; F02D 41/20; F02D 41/221; F02D 41/38; F02D 2041/2034; F02D 2041/2058; F02D 2041/224
USPC ..... 123/479, 490; 701/104, 105
See application file for complete search history.

(56) References Cited

U.S. PATENT DOCUMENTS

| | | | | |
|---|---|---|---|---|
| 2014/0311459 | A1* | 10/2014 | Katsurahara | F02D 41/30 123/478 |
| 2016/0363076 | A1* | 12/2016 | Kojima | F02D 41/20 |
| 2017/0226950 | A1* | 8/2017 | Tanaka | F02D 41/20 |
| 2020/0284214 | A1 | 9/2020 | Inaba et al. | |
| 2020/0309056 | A1* | 10/2020 | Fujisaki | F02D 41/22 |
| 2021/0164414 | A1* | 6/2021 | Oki | F02D 41/20 |
| 2021/0239063 | A1* | 8/2021 | Oki | F02D 41/401 |

FOREIGN PATENT DOCUMENTS

JP 2016-33343 A 3/2016

OTHER PUBLICATIONS

U.S. Appl. No. 17/333,207, filed May 28, 2021, Kato et al.
U.S. Appl. No. 17/333,088, filed May 28, 2021, Kato et al.

* cited by examiner

*Primary Examiner* — Erick R Solis
(74) *Attorney, Agent, or Firm* — Posz Law Group, PLC

(57) ABSTRACT

An injection control device includes: a fuel injection quantity command value output unit that outputs a command value for a fuel injection quantity of the fuel injection valve; a fuel injection quantity correction unit that calculates an A/F correction amount and corrects the command value of the fuel injection quantity; and a controller that executes current control on the fuel injection valve. The controller executes current area correction. The injection control device further includes an area correction abnormality determination unit that determines an area correction abnormality. The area correction abnormality determination unit changes the abnormality determination value.

4 Claims, 5 Drawing Sheets

INJECTION CONTROL DEVICE

CROSS REFERENCE TO RELATED APPLICATION

The present application claims the benefit of priority from Japanese Patent Application No. 2020-111597 filed on Jun. 29, 2020. The entire disclosure of the above application is incorporated herein by reference.

TECHNICAL FIELD

The present disclosure relates to an injection control device that controls fuel injection to an internal combustion engine by current-driving a fuel injection valve.

BACKGROUND

In a comparative example, an injection control device is used to inject fuel into an internal combustion engine, such as an automobile engine, by opening and closing a fuel injection valve which is called an injector. The injection control device opens the fuel injection valve that is electrically drivable by passing current to the fuel injection valve. In recent years, due to tightening of PN regulations, micro-injection, that is, partial-lift injection has been frequently used. A high injection accuracy is required to improve fuel efficiency and reduce the amount of harmful substance emission. Thus, valve opening control is executed in such a manner that an energization current profile corresponding to a command injection quantity is set, and the injection control device supplies current to the fuel injection valve on the basis of the energization current profile.

SUMMARY

An injection control device includes: a fuel injection quantity command value output unit that outputs a command value for a fuel injection quantity of the fuel injection valve; a fuel injection quantity correction unit that calculates an A/F correction amount and corrects the command value of the fuel injection quantity; and a controller that executes current control on the fuel injection valve. The controller executes current area correction. The injection control device further includes an area correction abnormality determination unit that determines an area correction abnormality. The area correction abnormality determination unit changes the abnormality determination value.

BRIEF DESCRIPTION OF DRAWINGS

The above and other features and advantages of the present disclosure will be more clearly understood from the following detailed description with reference to the accompanying drawings. In the accompanying drawings.

DESCRIPTION OF EMBODIMENTS

Figure 1:
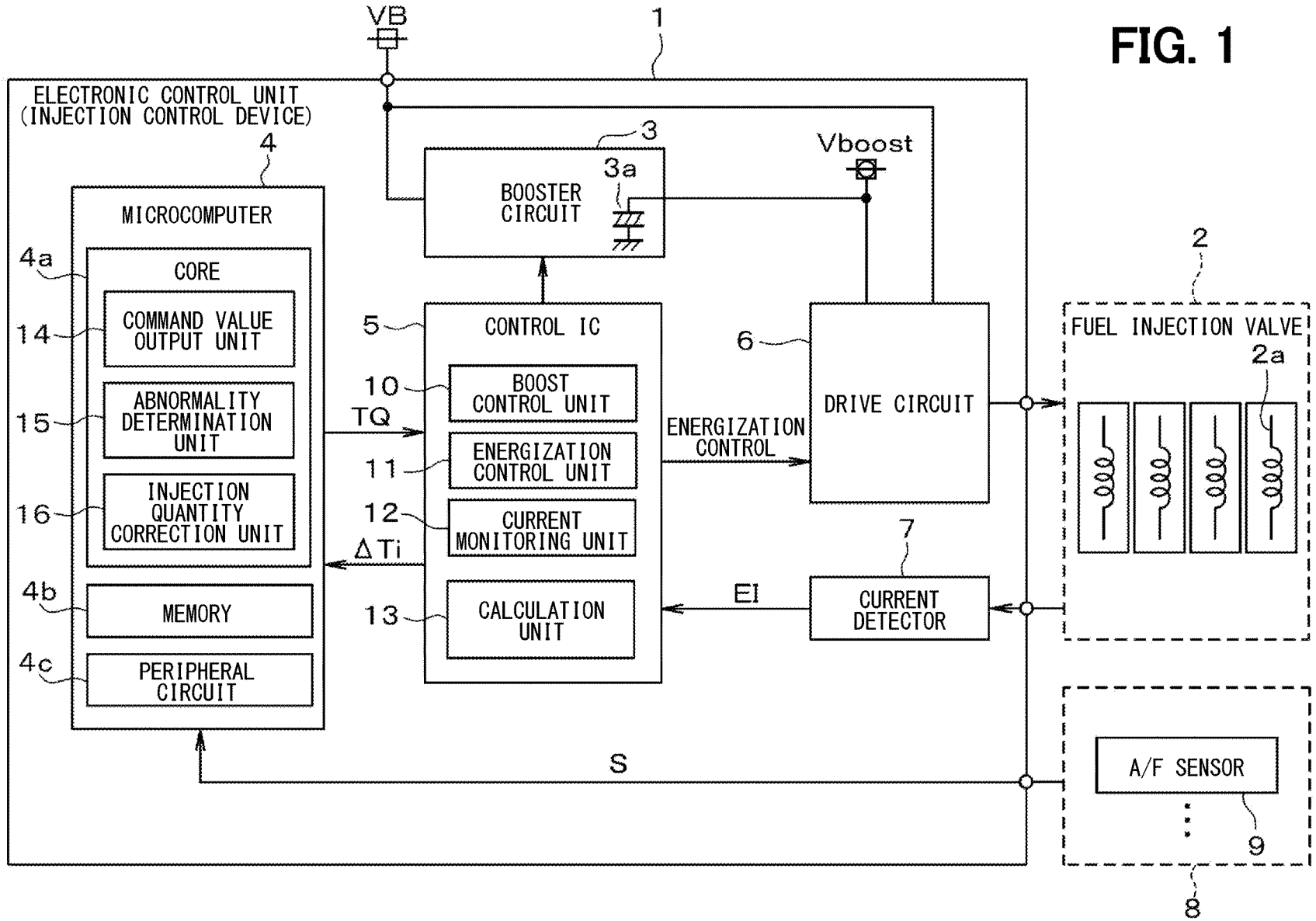
FIG. 1 is a block diagram illustrating the electrical configuration of an injection control device according to an embodiment.

In controlling the fuel injection valve, the gradient of an energization current of the fuel injection valve may become lower than the gradient of the energization current profile due to various factors such as a peripheral temperature environment and aged deterioration, and an actual injection quantity may thus become lower than the command injection quantity. Since the fuel injection quantity is obtained corresponding to an integrated value of the energization current, in a comparative example technique, current area correction is executed in such a manner that the gradient of the energization current is detected by monitoring the current at driving of the fuel injection valve and an energization time is extended according to the detected gradient. The command injection quantity is calculated according to a load of the internal combustion engine or the like. At this time, an actual air-fuel ratio is detected in exhaust gas by an A/F sensor or the like and compared with a target air-fuel ratio, and the command injection quantity is corrected using feedback control.

When the current area correction is executed in controlling energization of the fuel injection valve, in order to prevent an area correction amount, that is, the energization time from abnormally increasing, it is desirable to set an upper limit, as an abnormality determination value, on the area correction amount. At this time, when the area correction amount reaches the upper limit, it is determined that an area correction abnormality is present, and the current area correction is stopped. However, if the correction is executed until the area correction amount reaches the upper limit, the correction may become excessive correction, which may result in excessive fuel injection. In this case, the air-fuel ratio detected by the A/F sensor becomes rich, and the A/F correction amount based on the air-fuel ratio is disadvantageously largely deviated to the lean side. Further, the fuel injection quantity may become leaner due to the stop of the current area correction based on the abnormality determination.

In view of this, one example of the present disclosure provides an injection control device capable of appropriately detecting, on the basis of an area correction amount for an energization time, an abnormality of current area correction based on an integrated value of energization current in controlling energization of a fuel injection valve.

According to one example embodiment, an injection control device controls fuel injection by current-driving a fuel injection valve that supplies fuel to an internal combustion engine and includes: a fuel injection quantity command value output unit that outputs a command value for a fuel injection quantity of the fuel injection valve; a fuel injection quantity correction unit that calculates an A/F correction amount on the basis of detection of an air-fuel ratio of the internal combustion engine and corrects the command value of the fuel injection quantity; and a controller that executes current control on the fuel injection valve on the basis of an energization current profile indicating a relationship between an energization time and an energization current value for obtaining an energization current integrated value corresponding to the fuel injection quantity command value. The controller executes current area correction by calculating, on the basis of a difference between an integrated current value of the energization current profile and an integrated current value of a current flowing through the fuel injection valve detected by a current detector, an area correction amount for the energization time so that the integrated current values become equal to each other. The injection control device further includes an area correction abnormality determination unit that determines that an area correction abnormality is present when the area correction amount is equal to or larger than an abnormality determination value. The area correction abnormality determination unit changes the abnormality determination value using the A/F correction amount.

According to the above configuration, in executing current control on the fuel injection valve, since the fuel injection quantity corresponding to the integrated value of the energization current is obtained, the controller executes the current area correction by calculating, on the basis of a difference between an integrated current value of the energization current profile and an integrated current value of the current that flows through the fuel injection valve and is detected by the current detector for the energization time so that the integrated current values become equal to each other. In this case, typically, the gradient of the actual current value detected by the current detector is deviated from an ideal gradient of the energization current indicated by the energization current profile in a decreasing direction. Thus, the current area correction described above makes it possible to obtain an energization current integrated value for the fuel injection valve corresponding to the fuel injection quantity command value and thus obtain an appropriate fuel injection quantity. Further, the area correction abnormality determination unit makes it possible to determine that an area correction abnormality is present when the area correction amount is equal to or larger than the abnormality determination value.

At this time, if the abnormality determination value is set to a relatively small fixed value, it is frequently determined that an abnormality is present. On the other hand, if the abnormality determination value is set to a relatively large fixed value, excessive correction is executed, which may result in excessive fuel injection. Thus, the area correction abnormality determination unit changes the abnormality determination value using the A/F correction amount for correcting the command value for the fuel injection quantity on the basis of detection of the air-fuel ratio. Consequently, it is possible to execute the area correction abnormality determination on the basis of both the A/F correction amount and the area correction amount for the current area correction.

Thus, for example, when the area correction amount for the current area correction increases even through the A/F correction amount is present at the lean side, it is possible to promptly execute the area correction abnormality determination before fuel is excessively injected due to excessive correction. As a result, it is possible to obtain an excellent effect capable of appropriately detecting, on the basis of the area correction amount for the energization time, an abnormality of the current area correction based on the integrated value of the energization current in controlling energization of the fuel injection valve.

Hereinafters, an embodiment applied to direct-injection control for an automobile gasoline engine as an internal combustion engine will be described with reference to the drawings. An electronic control unit 1 serving as an injection control device according to the present embodiment is called an ECU (electronic control unit) and controls fuel injection of a fuel injection valve 2 mounted on each cylinder of an engine as illustrated in FIG. 1. The fuel injection valve 2 is also called an injector. The fuel injection valve 2 directly injects fuel into the corresponding cylinder of the engine by energizing a solenoid coil 2*a* to drive a needle valve. FIG. 1 illustrates an example of a four-cylinder engine. However, the present disclosure can also be applied to, for example, a three-cylinder engine, a six-cylinder engine, or an eight-cylinder engine. Alternatively, the present disclosure may also be applied to an injection control device for a diesel engine.

As illustrated in FIG. 1, the electronic control unit 1 has an electrical configuration including a booster circuit 3, a microcomputer 4, a control IC 5, a drive circuit 6, and a current detector 7. The microcomputer 4 includes one or more cores 4*a*, a memory 4*b* such as a ROM and a RAM, and a peripheral circuit 4*c* such as an A/D converter. Sensor signals S from various sensors 8 for detecting the operating state of the engine are input to the microcomputer 4. As described later, the microcomputer 4 obtains a command value for a fuel injection quantity on the basis of, for example, a program stored in the memory 4*b* and the sensor signals S acquired from the various sensors 8. The control IC 5 may be also referred to as a controller 5.

At this time, the various sensors 8 include an A/F (air-fuel) sensor 9 which is disposed on an exhaust path of the engine to detect an air-fuel ratio of exhaust gas. Although not illustrated, in addition to the A/F sensor 9, the various sensors 8 include, for example, a water temperature sensor which detects the temperature of an engine cooling water, a crank angle sensor which detects a crank angle of the engine, an air flow meter which detects the amount of intake air of the engine, a fuel pressure sensor which detects the pressure of fuel injected into the engine, and a throttle opening sensor which detects a throttle opening. FIG. 1 illustrates the sensors 8 in a simplified manner.

A core 4*a* of the microcomputer 4 implements functions of a fuel injection quantity command value output unit 14, an area correction abnormality determination unit 15, and a fuel injection quantity correction unit 16. Among these units, the fuel injection quantity command value output unit 14 grasps an engine load from the sensor signals S of the various sensors 8, calculates a fuel injection quantity required for the fuel injection valve 2 on the basis of the engine load, and outputs, to the control IC 5, the calculated fuel injection quantity as a fuel injection quantity command value TQ together with injection start instruction time t0. Details of the area correction abnormality determination unit 15 will be described later. In FIG. 1, the fuel injection quantity command value output unit 14 may be referred to as "COMMAND VALUE OUTPUT UNIT", the rea correction abnormality determination unit 15 may be referred to as "ABNORMALITY DETERMINATION UNIT", and the fuel injection quantity correction unit 16 may be referred to as "INJECTION QUANTITY CORRECTION UNIT".

At this time, as will be described later in description of actions, the fuel injection quantity correction unit 16 calculates, on the basis of the air-fuel ratio detected by the A/F sensor 9, an A/F correction amount CV so as to bring the air-fuel ratio to a target air-fuel ratio and corrects the fuel injection quantity command value TQ. In this manner, air-fuel ratio feedback control for the fuel injection quantity command value TQ is executed. Although not described in detail, in the microcomputer 4, A/F learning is executed on the basis of an A/F correction history, and a learning correction value is factored into the calculation of the A/F correction amount CV.

The control IC 5 is an integrated circuit device such as an ASIC. Although not illustrated, the control IC 5 includes, for example, a logic circuit, a control main body such as a CPU, a storage unit such as a RAM, a ROM, or an EEPROM, and a comparison unit such as a comparator, or the like. The control IC 5 executes current control or the like on the fuel injection valve 2 through the drive circuit 6 using hardware and software configurations thereof. At this time, as described below, the control IC 5 has functions of a boost control unit 10, an energization control unit 11, a current monitoring unit 12, and an area correction amount calculation unit 13. In FIG. 1, the area correction amount calculation unit 13 may be referred to as "CALCULATION UNIT".

Although not illustrated in detail, a battery voltage VB is input to the booster circuit 3, and the booster circuit 3 boosts the battery voltage VB and charges a booster capacitor 3*a* serving as a charging unit with boost voltage Vboost. At this time, the boost control unit 10 controls the operation of the booster circuit 3 to boost the input battery voltage VB and charge the booster capacitor 3*a* with the boost voltage Vboost up to a full charge voltage. The boost voltage Vboost is supplied to the drive circuit 6 as power for driving the fuel injection valve 2.

The battery voltage VB and the boost voltage Vboost are input to the drive circuit 6. Although not illustrated, the drive circuit 6 includes a transistor for applying the boost voltage Vboost to the solenoid coil 2*a* of the fuel injection valve 2 of each cylinder, a transistor for applying the battery voltage VB to the solenoid coil 2*a*, and a cylinder selection transistor which selects the cylinder to be energized, or the like. At this time, each of the transistors of the drive circuit 6 is turned on and off by the energization control unit 11. Accordingly, the drive circuit 6 drives the fuel injection valve 2 by applying the voltage to the solenoid coil 2*a* in accordance with energization control of the energization control unit 11.

The current detector 7 includes, for example, a current detection resistor (not illustrated) and detects a current flowing through the solenoid coil 2*a*. The current monitoring unit 12 of the control IC 5 includes a comparator and an A/D converter (both of which are not illustrated), or the like. The current monitoring unit 12 monitors, through the current detector 7, an energization current value EI which is a value of the current actually flowing through the solenoid coil 2*a* of the fuel injection valve 2 of each cylinder.

An energization current profile PI is stored in the control IC 5. The energization current profile PI indicates an ideal relationship between an energization time Ti and the energization current value for obtaining an energization current integrated value of the fuel injection valve 2 corresponding to the fuel injection quantity command value TQ. The energization control unit 11 of the control IC 5 executes current control on the fuel injection valve 2 through the drive circuit 6 on the basis of the energization current profile PI. At this time, in controlling the fuel injection valve 2, the gradient of the energization current of the fuel injection valve 2 may become lower than the gradient of the energization current profile PI due to various factors such as a peripheral temperature environment and aged deterioration, and an actual injection quantity may thus become lower than the command injection quantity. On the other hand, in controlling energization of the fuel injection valve 2, a fuel injection quantity corresponding to, that is, proportional to the integrated value of the energization current.

Thus, the energization control unit 11 executes, on the basis of the difference between an integrated current value of the energization current profile PI and an integrated current value of the energization current value EI, which is the value of the current actually flowing through the fuel injection valve 2, detected by the current detector 7, current area correction by calculating an area correction amount ΔTi for the energization time so as to make the integrated current values equal to each other. Current area correction control executed by the energization control unit 11 of the control IC 5 at partial-lift injection of the fuel injection valve 2 will be briefly described with reference to FIG. 2.

In the control based on the energization current profile PI, when energization is started at ON timing t0, the energization current gradually increases in a slight curve and reaches a peak current Ipk at time to through energization for the energization time Ti, and a fuel injection quantity corresponding to the fuel injection quantity command value TQ is obtained. However, the actual energization current value EI of the fuel injection valve 2 increases in a curve with a gentler gradient than the curve in the energization current profile PI and reaches a current value lower than the peak current Ipk at the time ta. Thus, there is a shortage of the fuel injection quantity by a quantity corresponding to the difference between the integrated current value of the energization current profile PI and the integrated current value of the energization current value EI, in other words, the area in the graph between the curve of the energization current profile PI and the curve of the energization current value EI from the time t0 to the time ta in FIG. 2, that is, a quantity corresponding to an area difference A1.

In the current area correction control, the area correction amount calculation unit 13 calculates an area correction amount ΔTi for the energization time. The area correction amount ΔTi is determined so that the integrated current value of the energization current profile PI and the integrated current value of the energization current value EI become equal to each other, that is, the area difference A1 and an area A2 in FIG. 2 become equal to each other. Then, the energization control unit 11 corrects, that is, extends the energization time using the calculated area correction amount ΔTi, thereby compensating for the shortage of the fuel injection quantity described above.

For example, the following method can be used as a method for calculating the area correction amount ΔTi. First, time t1*n* to reach a first current threshold 11 and time t2*n* to reach a second current threshold 12 for the energization current profile PI, and time t1 to reach the first current threshold 11 and time t2 to reach the second current threshold 12 for the energization current value EI are obtained. Then, the area difference A1 is estimated from these time values, and the area correction amount ΔTi for obtaining the area A2 equal to the area difference A1 is calculated. An appropriate fuel injection quantity of the fuel injection valve 2 corresponding to the fuel injection quantity command value TQ can be obtained by executing such current area correction control. As illustrated in FIG. 1, the area correction amount ΔTi is input to the microcomputer 4 from the area correction amount calculation unit 13.

As described above, the microcomputer 4 has the function of the area correction abnormality determination unit 15 which determines that an area correction abnormality is present when the area correction amount ΔTi is equal to or larger than an abnormality determination value TML. When the area correction abnormality determination unit 15 determines that an area correction abnormality is present, the microcomputer 4 outputs a current area correction stop command to the control IC 5 to stop the current area correction. At this time, in the present embodiment, the area correction abnormality determination unit 15 changes the abnormality determination value TML on the basis of the A/F correction amount CV calculated by the fuel injection quantity correction unit 16.

Figure 3:
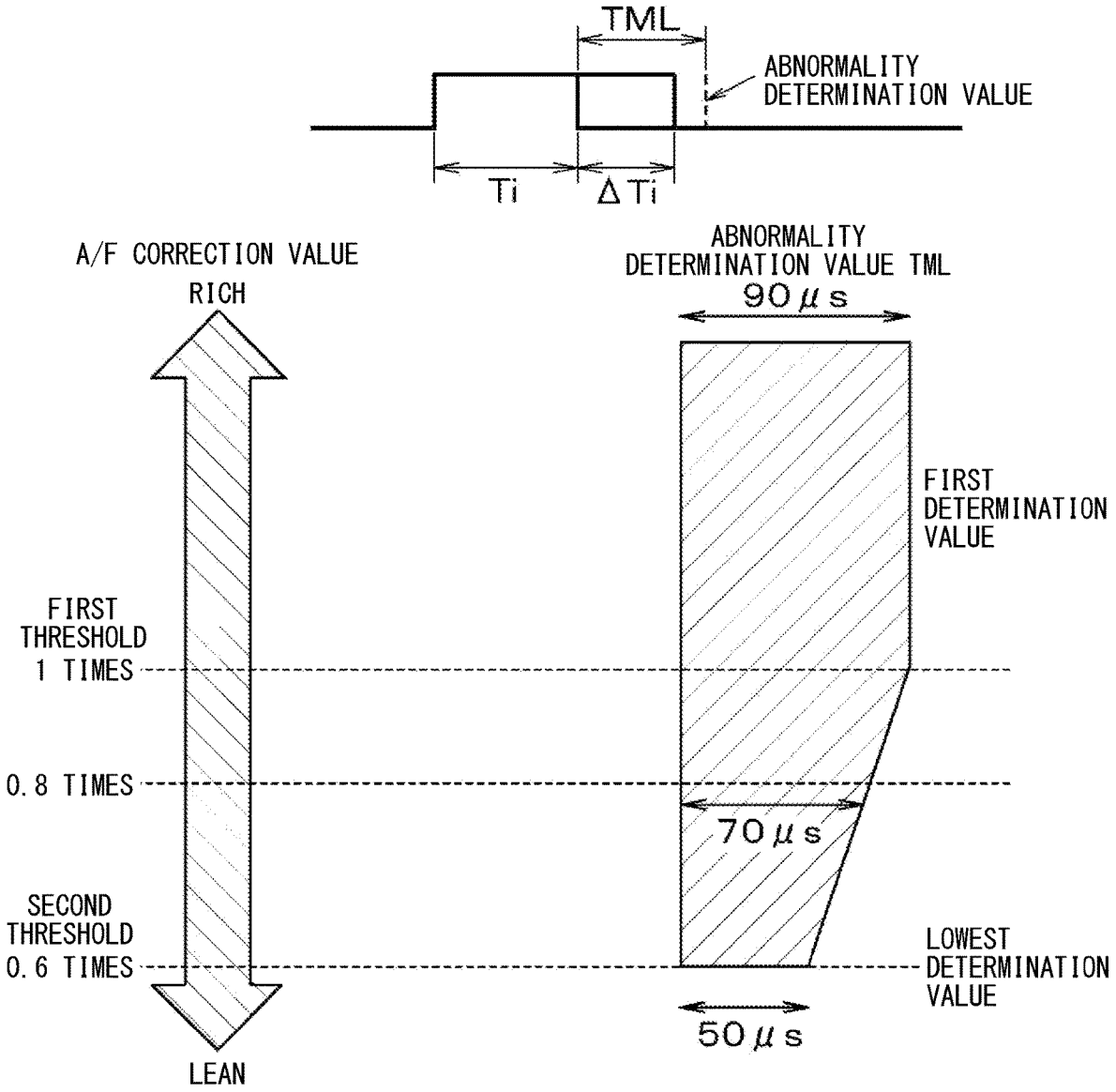
FIG. 3 is a diagram illustrating the relationship between an A/F correction amount and an abnormality determination value.

FIG. 3 illustrates a specific example of the relationship between the A/F correction amount CV and the abnormality determination value TML. As illustrated in FIG. 3, when the air-fuel ratio is equal to a stoichiometric value serving as a target air-fuel ratio, for example, 14.7, the A/F correction amount CV is set to 1 times, and the value at this time is defined as a first threshold. When the A/F correction amount CV is equal to or larger than the first threshold and thus present at a rich side, the abnormality determination value TML is set to a predetermined first determination value, for example, 90 μs. On the other hand, when the A/F correction amount CV is smaller than the first threshold and thus present at a lean side, the abnormality determination value TML is changed to a value smaller than the first determination value.

Further, at this time, when the A/F correction amount CV is smaller than a second threshold smaller than the first threshold, for example, 0.6 times at the lean side, the abnormality determination value TML is set to a predetermined lowest determination value, for example, 50 μs. When the A/F correction amount CV is between the first threshold and the second threshold, the abnormality determination value TML is gradually reduced according to reduction in the A/F correction amount CV. Specifically, the abnormality determination value TML is changed in such a manner as to linearly decrease from the first determination value, namely, 90 μs to the lowest determination value, for example, 50 μs. In the specific example, for example, when the A/F correction amount CV is 0.8 times, the abnormality determination value TML is set to 70 μs.

Figure 2:
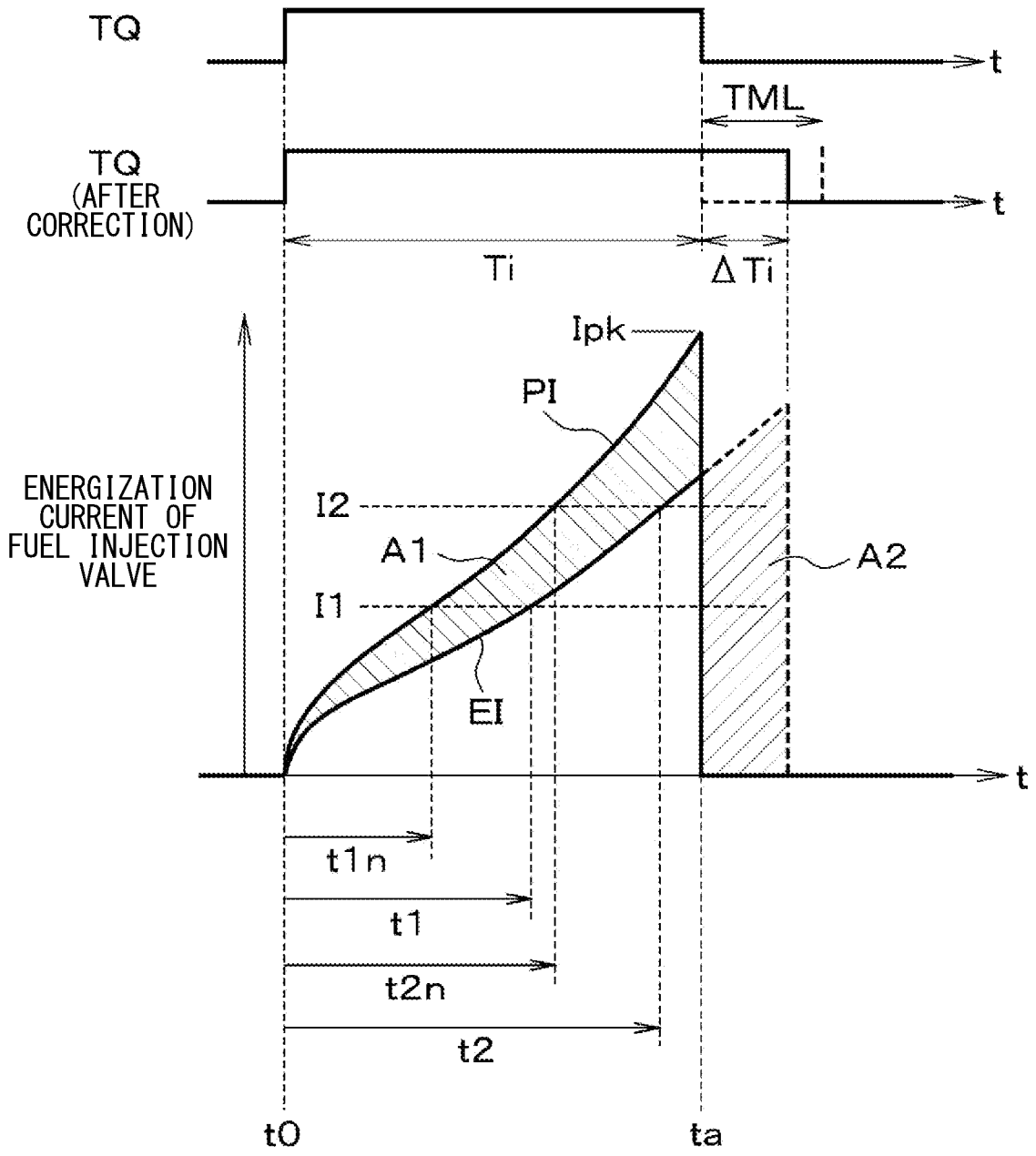
FIG. 2 is a diagram for describing current area correction control, illustrating the relationship between an energization time and an energization current of a fuel injection valve.

Next, actions and effects in the electronic control unit 1 configured in the above manner will be described with reference to FIGS. 4 and 5 in addition. The electronic control unit 1 having the above configuration executes the current area correction control using the fact that the fuel injection quantity corresponding to the integrated value of the energization current of the fuel injection valve 2 can be obtained in current control on the fuel injection valve 2 executed by the microcomputer 4 and the control IC 5. As illustrated in FIG. 2, in the current area correction control, the current area correction is executed by calculating, on the basis of the difference between the integrated current value of the energization current profile PI and the integrated current value of the energization current value EI, which is the value of the current flowing through the fuel injection valve 2, detected by the current detector 7, an area correction amount for the energization time so that the integrated current values become equal to each other.

In this case, typically, the gradient of the actual current value EI detected by the current detector 7 is deviated from an ideal gradient of the energization current indicated by the energization current profile PI in a decreasing direction. Thus, the current area correction as described above makes it possible to compensate for the shortage of the actual energization current integrated value, that is, the fuel injection quantity of the fuel injection valve 2 corresponding to the fuel injection quantity command value TQ and thus obtain an appropriate fuel injection quantity. At this time, in the present embodiment, the area correction abnormality determination unit 15 makes it possible to determine that an area correction abnormality is present when the area correction amount ΔTi is equal to or larger than the abnormality determination value TML. When it is determined that the area correction abnormality is present, the current area correction is stopped.

In the present embodiment, the microcomputer 4 executes the air-fuel ratio feedback control which corrects the fuel injection quantity command value TQ by calculating, on the basis of the air-fuel ratio detected by the A/F sensor 9, the A/F correction amount CV so as to bring the air-fuel ratio to the target air-fuel ratio for the fuel injection quantity command value TQ. In this case, as partly illustrated in FIGS. 4 and 5, when the air-fuel ratio detected by the A/F sensor 9 is rich, the A/F correction amount CV is lean, and the fuel injection quantity command value TQ is corrected in a decreasing direction. In this manner, the feedback control for the fuel injection quantity command value TQ is executed so as to achieve the target air-fuel ratio.

However, in a case where the area correction abnormality determination based on the area correction amount ΔTi is executed as described above, if the abnormality determination value TML in the area correction control is set to a relatively small fixed value, it is frequently determined that an abnormality is present. On the other hand, if the abnormality determination value TML is set to a relatively large fixed value, excessive correction is prone to occur, which may result in excessive fuel injection. If the abnormality determination value TML is set to a fixed value, appropriate control may not be executed due to the relationship with the correction of the fuel injection quantity command value TQ based on the air-fuel ratio.

Figure 5:
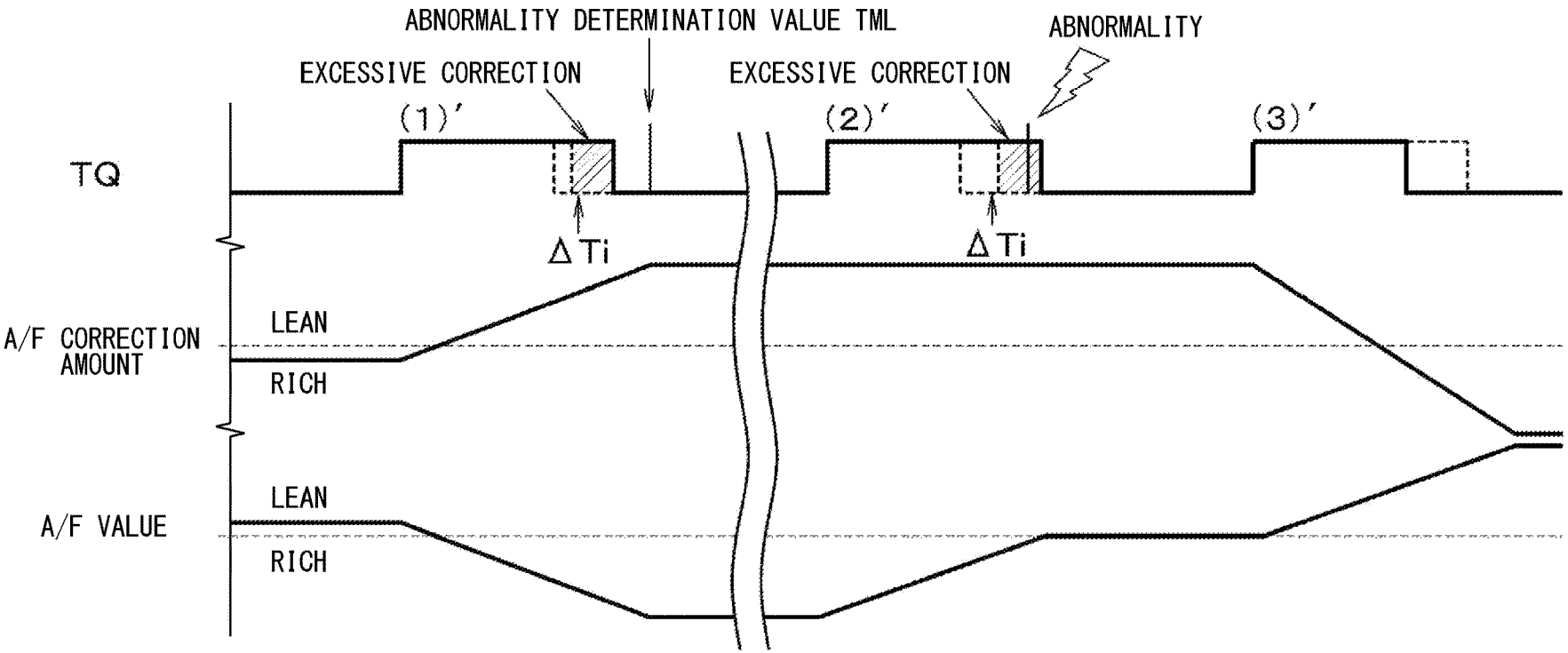
FIG. 5 is a diagram illustrating a state of the A/F correction amount and area correction abnormality determination in a comparative example.

FIG. 5 illustrates, as a comparative example, the state of variations in the A/F correction amount CV in a case where the abnormality determination value TML is fixed to, for example, 90 μs, which is the first determination value. In this comparative example, at fuel injection (1)', the air-fuel ratio detected by the A/F sensor 9 is rich, and the A/F correction amount CV is lean. In this state, at fuel injection (2)' thereafter, if the area correction amount ΔTi increases due to the occurrence of any abnormality, disadvantageously, the fuel injection becomes excessive, and the A/F correction amount CV is continuously kept largely deviating to the lean side. Further, at the next fuel injection (3)', the fuel injection quantity may become leaner due to the stop of the current area correction based on the abnormality determination.

Figure 4:
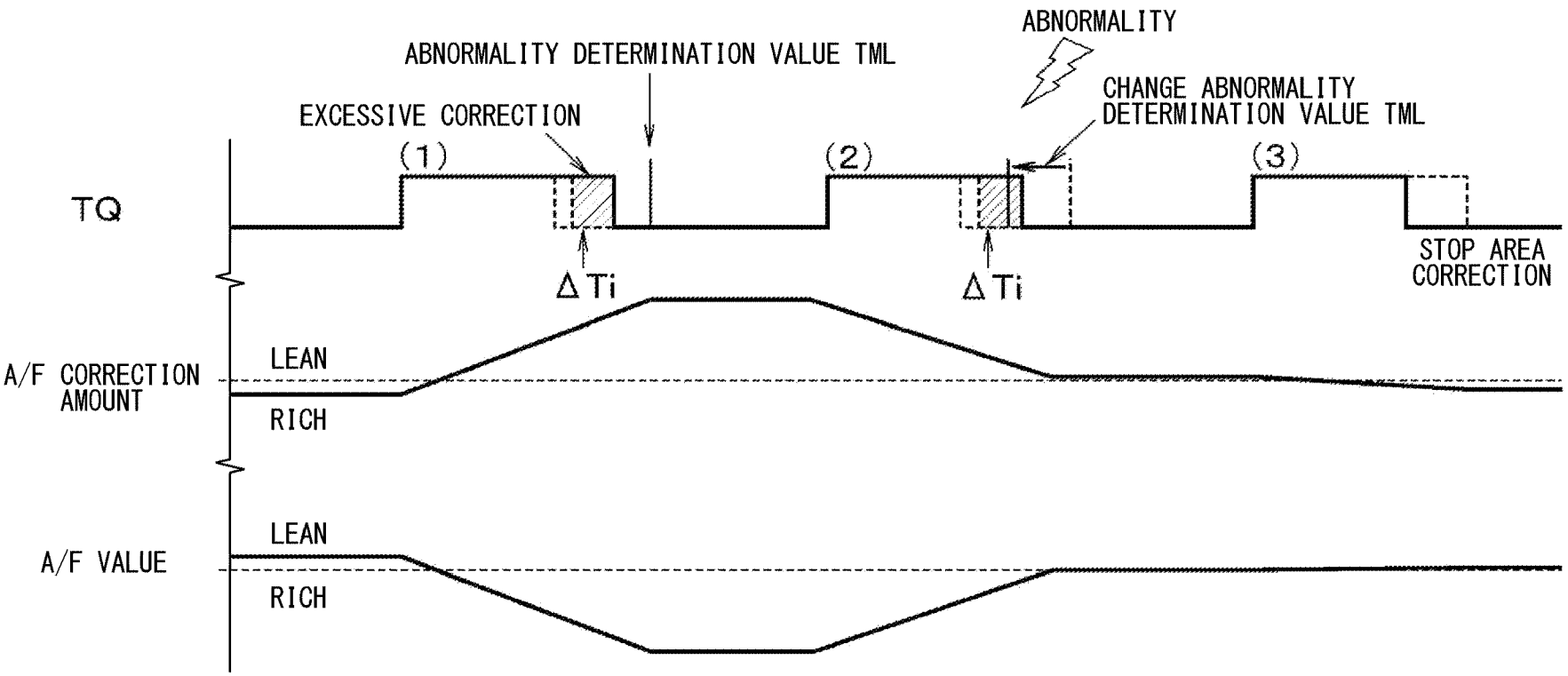
FIG. 4 is a diagram illustrating a state of the A/F correction amount and area correction abnormality determination in the embodiment.

On the other hand, FIG. 4 illustrates the state of variations in the A/F correction amount CV in a case where the abnormality determination value TML is changed in the present embodiment. In the present embodiment, at fuel injection (1), in a state where the A/F correction amount CV is lean, the abnormality determination value TML is changed in such a manner as to become smaller than the first determination value. Thus, at the next fuel injection (2), even if the area correction amount ΔTi becomes relatively large due to the occurrence of any abnormality, the abnormality determination is promptly executed, thereby preventing excessive injection. Consequently, at the next fuel injection (3), the current area correction is stopped, and it is possible to prevent the A/F correction amount CV from being continuously kept lean.

In this manner, in the present embodiment, the A/F correction amount CV is calculated on the basis of the air-fuel ratio detected by the A/F sensor 9. The fuel injection quantity correction unit 16 which corrects the fuel injection quantity command value TQ is provided. The area correction abnormality determination unit 15 changes the abnormality determination value TML for the area correction amount ΔTi using the A/F correction amount CV. With this configuration, it is possible to execute the area correction abnormality determination on the basis of both the A/F correction amount CV and the area correction amount ΔTi for the current area correction. Thus, according to the present embodiment, it is possible to obtain an excellent effect capable of appropriately detecting, on the basis of the area correction amount for the energization time, an abnormality of the current area correction based on the integrated value of the energization current in controlling energization of the fuel injection valve 2.

In particular, in the present embodiment, as illustrated in FIG. 3, the area correction abnormality determination unit 15 sets, on the basis of the A/F correction amount CV, the abnormality determination value TML to the predetermined first determination value when the A/F correction amount CV is equal to or larger than the first threshold and thus present at the rich side and, changes the abnormality determination value TML to a value smaller than the first determination value when the A/F correction amount CV is smaller than the first threshold and thus present at the lean side.

According to this configuration, when the A/F correction amount CV is equal to or larger than the first threshold and thus present at the rich side, the area correction abnormality determination can be executed at normal timing by setting the abnormality determination value TML to the predetermined first determination value. On the other hand, when the A/F correction amount CV is smaller than the first threshold and thus present at the lean side, the abnormality determination can be executed at early timing by changing the abnormality determination value TML to a value smaller than the first determination value, which makes it possible to stop the current area correction before the current area correction is excessively executed. In addition, it is possible to prevent in advance the fuel injection quantity from becoming abnormally lean.

Further, in the present embodiment, as illustrated in FIG. 3, when the A/F correction amount CV is smaller than the first threshold and thus present at the lean side, the abnormality determination value TML is gradually reduced according to reduction in the A/F correction amount CV. This makes it possible to more precisely change the abnormality determination value TML, which is more effective. In addition, since the abnormality determination value TML is set to the predetermined lowest determination value when the A/F correction amount CV is smaller than the second threshold smaller than the first threshold, it is possible to prevent the timing of the area correction abnormality determination from being needlessly advanced.

In executing the area correction control on the fuel injection valve 2, the above embodiment employs a relatively simple method in which the time t1*n* to reach the first current threshold 11 and the time t2*n* to reach the second current threshold 12 for the energization current profile PI, and the time t1 to reach the first current threshold 11 and the time t2 to reach the second current threshold 12 for the actual energization current value EI are obtained, and the area difference A1 is then estimated from these time values. However, the area correction amount ΔTi may be obtained by employing other various methods. In the above embodiment, the abnormality determination value TML is linearly changed between the first threshold and the second threshold for the A/F correction amount CV. However, the abnormality determination value TML may be changed in two or more stages.

The microcomputer 4 and the control IC 5 described above may be integrated with each other. In this case, it is desirable to use an arithmetic processor capable of executing a high-speed operation. The means and the functions provided by the microcomputer 4 and the control IC 5 can be provided by software recorded in a substantive memory device and a computer executing the software, software only, hardware only, or a combination thereof. For example, when the control device is provided by an electronic circuit as hardware, the control device can include a digital circuit including one or more logic circuits or an analog circuit. Further, for example, when the control device executes various control operations using software, a program is stored in the storage unit, and the control main body executes the program to implement a method corresponding to the program.

In addition, the hardware configuration such as the fuel injection valve, the booster circuit, the drive circuit, and the current detector can be variously modified. The present disclosure has been described in accordance with the embodiment. However, it is to be understood that the present disclosure is not limited to the embodiment and structure. The present disclosure includes various modifications and modifications within the equivalent range. In addition, various combinations and modes, as well as other combinations and modes including only one element, more, or less, are within the scope and idea of the present disclosure.

The controller (control unit) and the method described in the present disclosure may be implemented by a dedicated computer including a processor programmed to execute one or more functions embodied by a computer program and a memory. Alternatively, the controller and the method described in the present disclosure may be implemented by a dedicated computer including a processor including one or more dedicated hardware logic circuits. Alternatively, the controller and the method described in the present disclosure may be implemented by one or more dedicated computers including the combination of a processor programmed to execute one or more functions and a memory and a processor including one or more hardware logic circuits. The computer program may be stored, as an instruction executed by a computer, in a computer-readable non-transitory tangible storage medium.

The invention claimed is:

1. An injection control device configured to control fuel injection by current-driving a fuel injection valve configured to supply fuel to an internal combustion engine, the injection control device comprising:

a fuel injection quantity command value output unit configured to output a command value for a fuel injection quantity of the fuel injection valve;

a fuel injection quantity correction unit configured to calculate an air-fuel correction amount based on detection of an air-fuel ratio of the internal combustion engine and correct the command value of the fuel injection quantity; and a controller configured to execute current control on the fuel injection valve based on an energization current profile indicating a relationship between an energization time and an energization current value for obtaining an energization current integrated value corresponding to the fuel injection quantity command value, wherein:

the controller is configured to execute current area correction by calculating, based on a difference between an integrated current value of the energization current profile and an integrated current value of a current flowing through the fuel injection valve detected by a current detector, an area correction amount for the energization time to cause the integrated current value of the energization current profile and the integrated current value of the current to be equal to each other;

the injection control device further comprises an area correction abnormality determination unit configured to determine that an area correction abnormality is present when the area correction amount is equal to or larger than an abnormality determination value; and the area correction abnormality determination unit is configured to change the abnormality determination value using the air-fuel correction amount.

2. The injection control device according to claim 1, wherein:

the area correction abnormality determination unit sets the abnormality determination value to a predetermined first determination value when the air-fuel correction amount is equal to or larger than a first threshold and present at a rich side, and changes the abnormality determination value to a value smaller than the first determination value when the air-fuel correction amount is smaller than the first threshold and present at a lean side.

3. The injection control device according to claim 1, wherein:

the area correction abnormality determination unit gradually reduces the abnormality determination value according to reduction in the A/F correction amount when the A/F correction amount is smaller than a first threshold and present at a lean side, and changes the abnormality determination value to a predetermined lowest determination value when the A/F correction amount is smaller than a second threshold smaller than the first threshold.

4. An injection control device comprising:

a processor; and a memory that stores an instruction configured to, when executed by the processor, cause the processor to:

control fuel injection by current-driving a fuel injection valve configured to supply fuel to an internal combustion engine;

output a command value for a fuel injection quantity of the fuel injection valve;

calculate an air-fuel correction amount based on detection of an air-fuel ratio of the internal combustion engine;

correct the command value of the fuel injection quantity;

execute current control on the fuel injection valve based on an energization current profile indicating a relationship between an energization time and an energization current value for obtaining an energization current integrated value corresponding to the fuel injection quantity command value;

execute current area correction by calculating, based on a difference between an integrated current value of the energization current profile and an integrated current value of a current flowing through the fuel injection valve detected by a current detector, an area correction amount for the energization time to cause the integrated current value of the energization current profile and the integrated current value of the current to be equal to each other;

determine that an area correction abnormality is present when the area correction amount is equal to or larger than an abnormality determination value; and change the abnormality determination value using the air-fuel correction amount.

* * * * *